US011041269B2

(12) United States Patent
Alolabi

(10) Patent No.: US 11,041,269 B2
(45) Date of Patent: Jun. 22, 2021

(54) INFLATABLE SHIRT DRYING SYSTEM

(71) Applicant: Zackery Ray Alolabi, Houston, TX (US)

(72) Inventor: Zackery Ray Alolabi, Houston, TX (US)

( * ) Notice: Subject to any disclaimer, the term of this patent is extended or adjusted under 35 U.S.C. 154(b) by 32 days.

(21) Appl. No.: 16/244,668

(22) Filed: Jan. 10, 2019

(65) Prior Publication Data

US 2019/0382946 A1 Dec. 19, 2019

Related U.S. Application Data

(60) Provisional application No. 62/615,709, filed on Jan. 10, 2018.

(51) Int. Cl.
*D06F 59/02* (2006.01)

(52) U.S. Cl.
CPC ..... *D06F 59/02* (2013.01)

(58) Field of Classification Search
CPC ..... A41H 5/02; D06F 59/02; D06F 59/00; D06F 71/00; D06F 73/00; D06F 73/02; D06F 71/20
USPC ... 223/66, 67, 68, 69, 70, 71, 72, 73, 74, 51
See application file for complete search history.

(56) References Cited

U.S. PATENT DOCUMENTS

| | | | | |
|---|---|---|---|---|
| 3,472,434 | A | 10/1969 | Cherry et al. | |
| 3,892,047 | A * | 7/1975 | Muller-Scherak | D06F 59/02 34/103 |
| 5,555,648 | A * | 9/1996 | Griffin | D06F 59/02 223/67 |
| 5,815,961 | A * | 10/1998 | Estes | D06F 73/02 38/14 |
| 6,581,677 | B2 | 6/2003 | Dukes-Dobos et al. | |
| 6,991,510 | B2 | 1/2006 | Nan | |
| 2010/0320240 | A1 | 12/2010 | Sadaoka | |
| 2017/0321688 | A1 * | 11/2017 | Shao | A63H 3/06 |

* cited by examiner

*Primary Examiner* — Nathan E Durham
*Assistant Examiner* — F Griffin Hall
(74) *Attorney, Agent, or Firm* — Boudwin Intellectual Property; Daniel Boudwin

(57) ABSTRACT

An inflatable shirt drying system. The inflatable shirt drying system includes a balloon having a torso and a pair of arms, wherein the balloon is designed to emulate the shape of a human torso when inflated. An inlet valve is disposed on the balloon in communication with an interior volume of the balloon. A plurality of micro-perforations are disposed across the balloon, wherein the micro-perforations emit a stream of fluid from the interior volume when the pressure within the balloon exceeds a threshold pressure. An air supply is securable to the inlet valve, wherein the air supply includes a pump that can inflate the balloon to a desired pressure.

11 Claims, 4 Drawing Sheets

INFLATABLE SHIRT DRYING SYSTEM

CROSS REFERENCE TO RELATED APPLICATIONS

This application claims the benefit of U.S. Provisional Application No. 62/615,709 filed on Jan. 10, 2018. The above identified patent application is herein incorporated by reference in its entirety to provide continuity of disclosure.

BACKGROUND OF THE INVENTION

The present invention relates to a shirt drying system. More particularly, the present invention pertains to a shirt drying system having an inflatable balloon with a plurality of micro-perforations, allowing a shirt to be dried from the outside and inside simultaneously.

Many people wear expensive T-shirts and dress shirts which need to be treated delicately to prevent damage thereto. Typically, when washing and drying clothing, people use a traditional drying machine, which often causes shrinkage, wrinkles, and the like to clothing. Should a shirt shrink, the user may be forced to buy a replacement, whereas correcting wrinkles in clothing can be time-consuming and frustrating as it typically requires a user to repeatedly iron the article of clothing. Alternatively, many people air dry their clothes by putting the clothing on a hanger to dry naturally, however this takes significantly longer to dry than a dryer, and often results in unsightly indentations in the shoulders of the shirt where the weight of the wet shirt pressed into the hanger. Therefore, there is a need in the art for a device that can quickly and efficiently dry a shirt without causing shrinkage, wrinkles, or hanger indentations.

In light of the devices disclosed in the known art, it is submitted that the present invention substantially diverges in design elements from the known art and consequently it is clear that there is a need in the art for an improvement to existing shirt drying systems. In this regard, the instant invention substantially fulfills these needs.

SUMMARY OF THE INVENTION

In view of the foregoing disadvantages inherent in the known types of shirt drying systems now present in the known art, the present invention provides an inflatable shirt drying system wherein the same can be utilized for providing convenience for the user when drying shirts quickly and without generating wrinkles.

The present system comprises a balloon having a torso and a pair of arms extending therefrom, such that the balloon is configured to emulate a human torso when in an inflated state. An inlet valve is disposed on the balloon, wherein the inlet valve is in fluid communication with an interior volume of the balloon. A plurality of micro-perforations are disposed across the balloon, wherein the plurality of micro-perforations are in fluid communication with the interior volume, such that when the pressure within the interior volume exceeds a threshold pressure, the plurality of micro-perforations emit a stream of fluid therefrom. An air supply is removably securable to the inlet valve, wherein the air supply comprises an air inlet, an air outlet, and a pump therebetween, wherein the pump is configured to inflate the balloon to a desired pressure. In some embodiments, the balloon further comprises a neck extending from an upper portion thereof, the neck configured to extend through an opening in a shirt. In another embodiment, the inlet valve is disposed on the neck. In other embodiments, the inlet valve comprises a one-way valve. In yet another embodiment, a ring is removably securable to the inlet valve, wherein the ring is configured to receive a fastener therethrough. In some embodiments, a base of the torso comprises a planar surface. In another embodiment, the air supply further comprises a heating element therein, wherein the heating element is configured to heat air passing through the air supply to a desired temperature. In other embodiments, the heating element comprises a heat control configured to adjust the temperature of the heating element. In yet another embodiment, the air supply further comprises a pressure sensor configured to detect the pressure within the interior volume. In some embodiments, the pump is configured to adjust the flowrate of air through the air supply to maintain a desired pressure within the interior volume as detected by the pressure sensor. In another embodiment, the air supply further comprises a pressure control configured to adjust the flowrate through the air outlet to a desired flowrate. In other embodiments, the plurality of micro-perforations are evenly distributed across the balloon.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
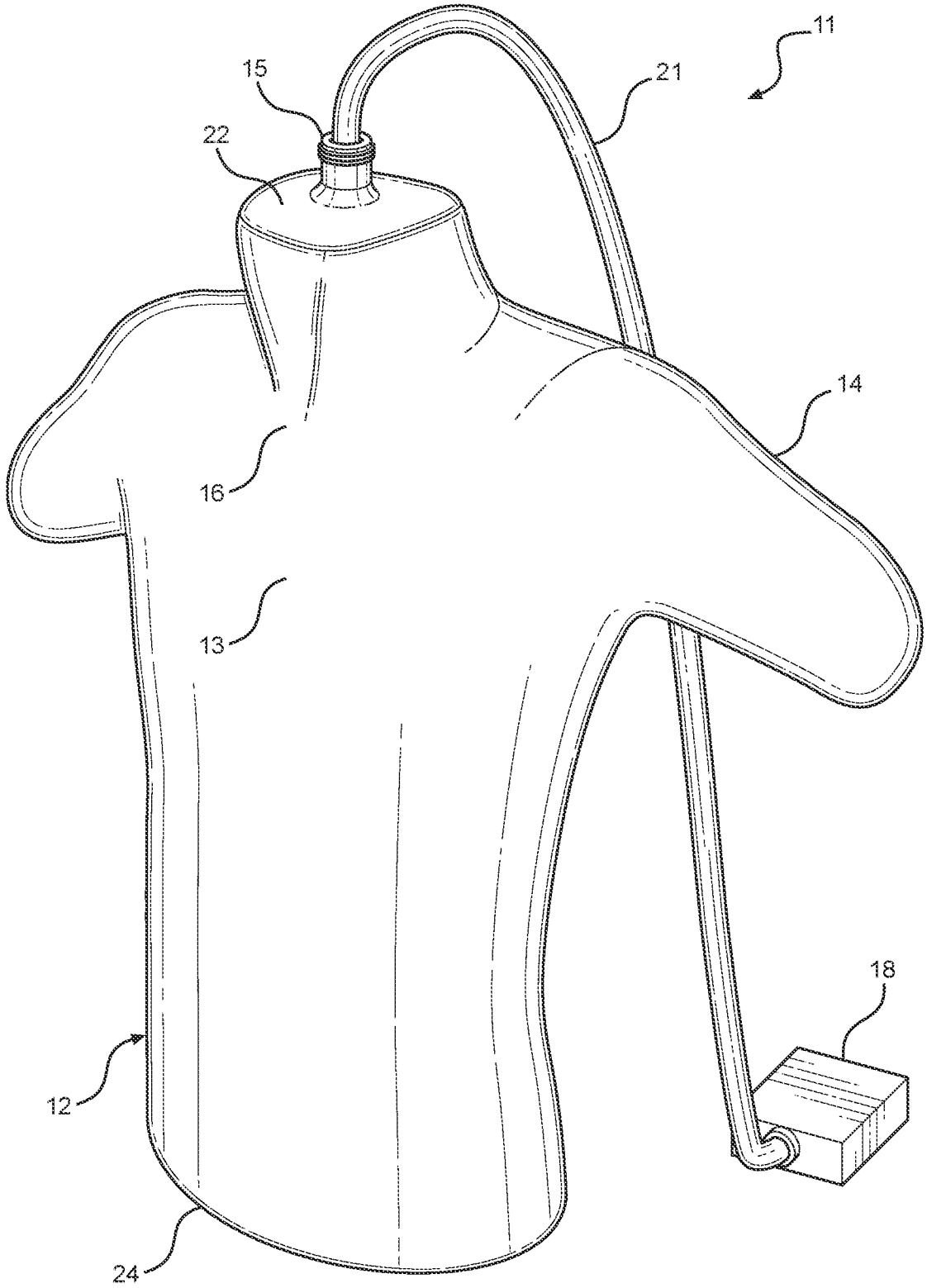
FIG. 1 shows a perspective view of an embodiment of the inflatable shirt drying system.

Reference is made herein to the attached drawings. Like reference numerals are used throughout the drawings to depict like or similar elements of the inflatable shirt drying system. The figures are intended for representative purposes only and should not be considered to be limiting in any respect.

Figure 3:
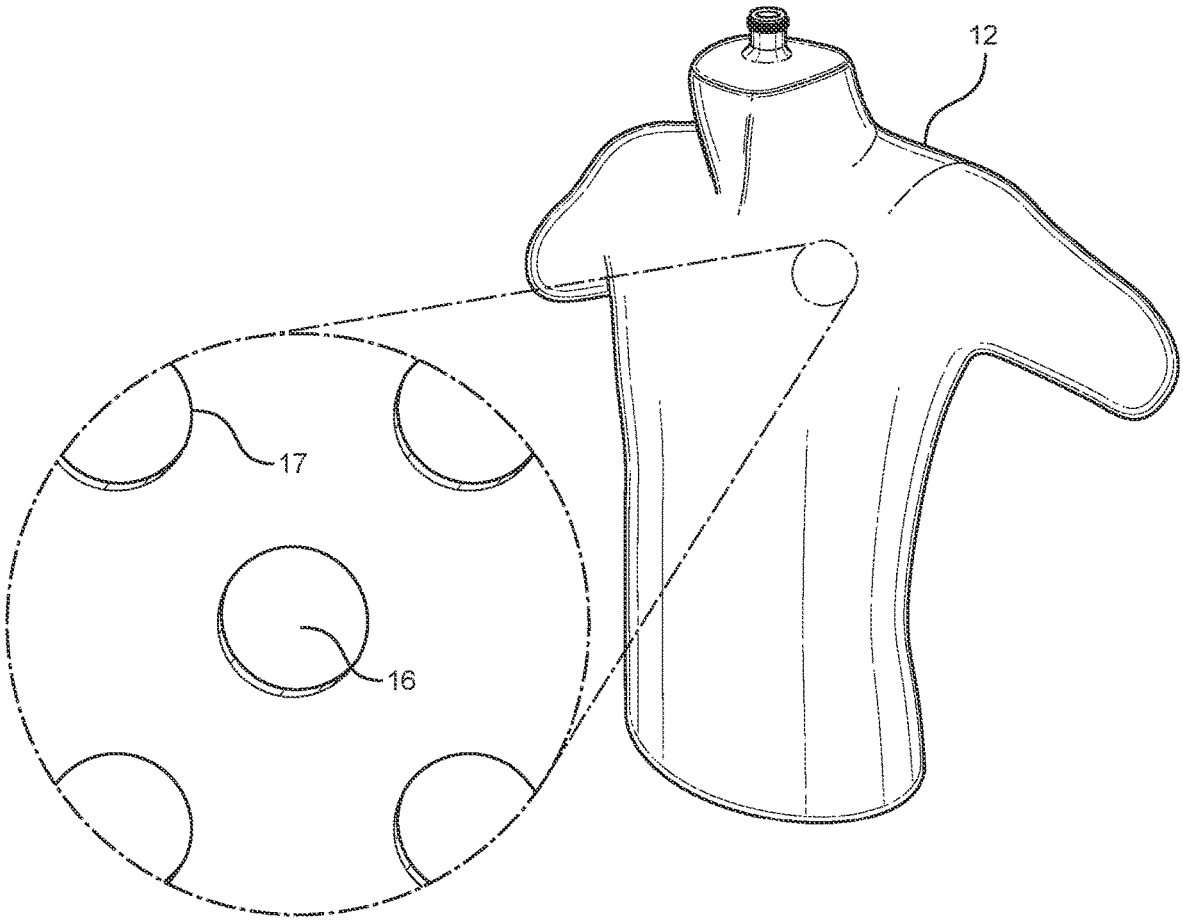
FIG. 3 shows an enlarged perspective view of the micro-perforations of an embodiment

Referring now to FIG. 1, there is shown a perspective view of an embodiment of the inflatable shirt drying system. The inflatable shirt drying system 11 comprises a balloon 12 having a torso 13 and a pair of arms 14 extending therefrom, such that the balloon 12 is configured to resemble a human torso when in an inflated state. The balloon 12 further comprises a plurality of micro-perforations (as shown in FIGS. 3, 17) thereacross, wherein the plurality of micro-perforations are in fluid communication with an interior volume 16 of the balloon 12. The balloon 12 is configured to receive a shirt thereon, wherein the pair of arms 14 extend through the sleeves of the shirt. In this way, fluid, such as air, expelled from the interior volume 16 through the plurality of micro-perforations is configured to dry an interior of the shirt while an exterior of the shirt is simultaneously dried via exposure to the surrounding atmosphere. Furthermore, the structure of the balloon 12 maintains the shirt in a position similar to that when the shirt is worn, thereby preventing the formation of wrinkles as typically caused by traditional drying machine usage.

In the illustrated embodiment, a base 24 of the balloon 12 comprises a planar surface, such that the base 24 is configured to rest flush on a support surface, such as a table. In this way, the balloon 12 can maintain stability when inflated on a surface, such that a user is able to use both hands to place a shirt about the balloon 12. Furthermore, in the illustrated embodiment, the balloon 12 further comprises a neck 22 configured to extend through a corresponding opening in a shirt, such that the shirt is stabilized on the balloon 12 in a desired position.

The balloon 12 further comprises an inlet valve 15 in fluid communication with the interior volume 16 of the balloon 12. The inlet valve 15 is configured to be a one-way valve, such that fluid, such as air, directed into the interior volume 16 remains therein. In the illustrated embodiment, the inlet valve 15 is disposed on the neck 22 such that the balloon 12 can be continuously inflated while a shirt is placed on the balloon 12, however in alternate embodiment, the inlet valve 15 is disposed on other accessible areas of the balloon 12, such as at an end of either of the pair of arms 14. The inlet valve 15 is further configured to removably secure an air outlet 21 thereto, wherein the air outlet 21 is in fluid communication with an air supply 18. The air supply 18 is configured to provide a stream of fluid through the air outlet 21 and into the interior volume 16 via the inlet valve 15. In this way, the balloon 12 can be maintained in an inflated position, allowing a shirt to dry thereon in a position emulated that of when the shirt is worn such that wrinkles do not form thereon.

Figure 2:
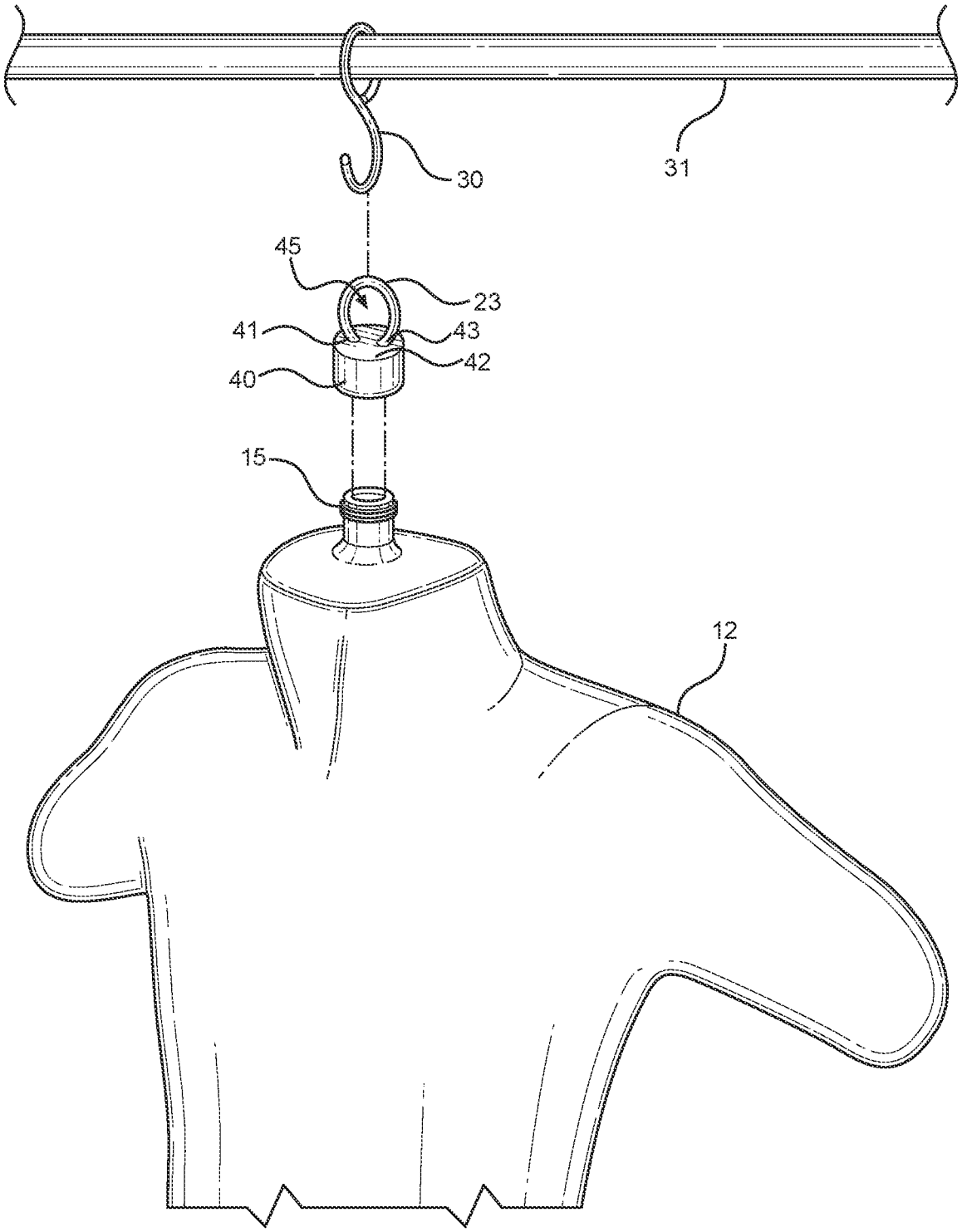
FIG. 2 shows an exploded view of an embodiment of the inflatable shirt drying system.

Referring now to FIG. 2, there is shown an exploded view of an embodiment of the inflatable shirt drying system. In the illustrated embodiment, a cap 40 is removably securable to the inlet valve 15. The cap includes a curved member 23 having a first end 41 affixed to an upper side 42 of the cap 40 and a second end 43 affixed to the upper side 42 of the cap 40. The curved member 23 defines a ring having an opening 45 configured to receive a fastener 30, such as a hook as shown in FIG. 2, for hanging the balloon from a support structure 31, which may be a horizontal rod as shown in FIG. 2. In the illustrated embodiment, the cap 40 is removably securable to the inlet valve 15 via threaded engagement, however in alternate embodiments, other fastening methods are contemplated, such as friction fit. The fastener 30 is further configured to removably secure to a rod 31, such that the balloon 12 can be hung therefrom, such as in a closet, wardrobe, or other storage location. In this way, the balloon 12 can be stored in a hanging position to allow easier storage. Additionally, hanging the balloon 12 while a shirt is drying thereon allows the shirt to dry more quickly, as the shirt is exposed to air on all sides thereof, thereby increasing surface area in contact with air such that convective drying is maximized. Furthermore, when the balloon 12 is no longer in use, the balloon 12 can be deflated and hung from the ring 23 such that the form factor of the balloon 12 is minimized for storage when not in use.

Referring now to FIG. 3, there is shown an enlarged perspective view of the micro-perforations of an embodiment of the inflatable shirt drying system. The balloon 12 further comprises a plurality of micro-perforations 17 disposed across a surface thereof, wherein the plurality of micro-perforations 17 are in fluid communication with the in tenor volume 16. The plurality of micro-perforations 17 are configured to expel a stream of fluid, such as air, from the interior volume 16 when the pressure within the interior volume 16 exceeds a threshold pressure. In this way, the balloon 12 can be fully inflated to allow the shirt to rest thereon in a desired position before air is forced from the interior volume 16 through the plurality of micro-perforations 17. In the illustrated embodiment, the plurality of micro-perforations 17 are evenly distributed across the balloon 12 such that air from the interior volume 16 is expelled across an entire surface of the balloon 12 at the same flowrate, allowing even drying of a shirt placed thereon.

Figure 4:
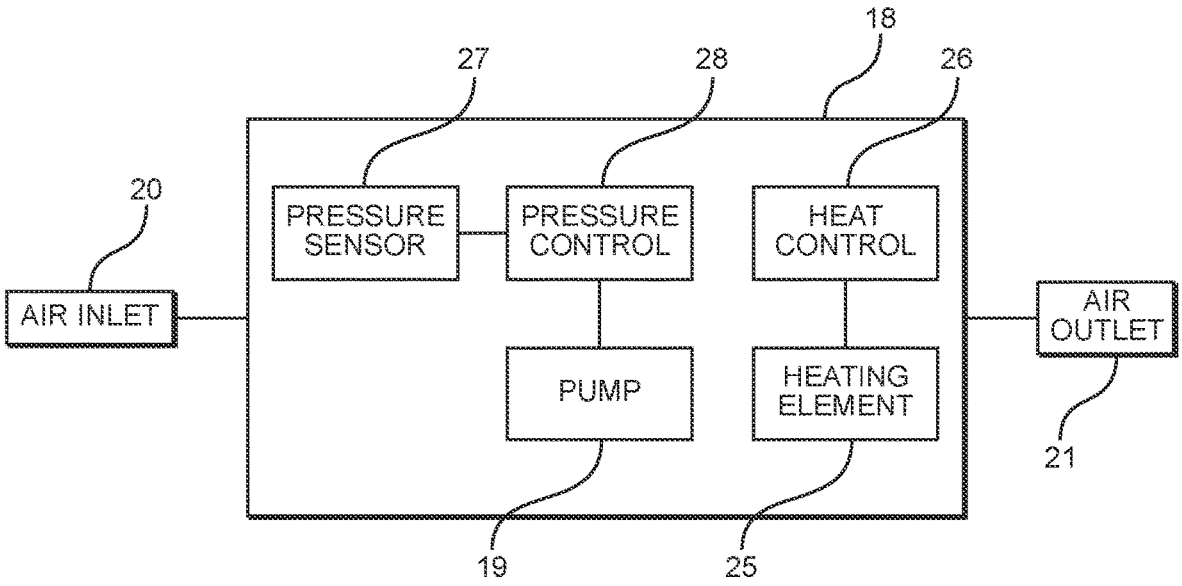
FIG. 4 shows a schematic view of the air supply of an embodiment of the inflatable shirt drying system.

Referring now to FIG. 4, there is shown a schematic view of the air supply of an embodiment of the inflatable shirt drying system. The inflatable shirt drying system further comprises an air supply 18 having a pump 19 therein, wherein the pump 19 is configured to draw air from the surrounding atmosphere via an air inlet 20 and expel the air through the air outlet 21 at a desired volumetric flowrate. In some embodiments, the air supply 18 is operably connected to a power source, such that the pump 19 is provided power thereby. In this way, the air supply 18 can maintain the balloon in an inflated position.

In the illustrated embodiment, the air supply 18 further comprises a heating element 25 configured to heat the air received by the air inlet 20 to a desired temperature. In this way, the air supplied to the balloon is at a desired increased temperature, such that a shirt placed thereon can be more efficiently dried thereby. In some embodiments, the air supply 18 further comprises a heat control 26 operably connected to the heating element 25 such that the user can selectively adjust the temperature of the heating element 25. In this way, the user can determine the optimal temperature of air to most efficiently dry clothing of various materials in order to minimize damage thereto, such as via shrinking.

In the illustrated embodiment, the air supply 18 further comprises a pressure control 28 operably connected to the pump 19 such that a user can selectively adjust the volumetric flowrate of fluid passed through the pump 19. In this way, the user can adjust the pump 19 to increase the pressure within the balloon should it be underinflated, or alternatively, decrease the pressure within the balloon should the balloon be in danger of bursting. In some embodiments, the air supply 18 further comprises a pressure sensor 27 operably connected to the pressure control 28 and the pump 19, such that the pressure sensor 27 is configured to detect the pressure within the balloon and adjust the flowrate output by the pump 19 to maintain a constant desired pressure within the balloon. In this y, the balloon is prevented from overinflating or underinflating, ensuring a constant stream of fluid expelled via the plurality of micro-perforations. This allows the user to ensure that a shirt placed thereon is efficiently and thoroughly dried in a desired position.

In one exemplary use, the user secures the air outlet 21 to the inlet valve such and adjusts the flowrate from the air supply 18 to a desired level. In some embodiments, the user can then set the desired temperature of the air expelled from the air outlet 21 for a particular material of the item of clothing. The balloon is then inflated, and a shirt is placed thereon, such that the pair of arms extend through the sleeves of the shirt. Air from the interior volume is then expelled from the plurality of micro-perforations and directed to an interior surface of the shirt, such that the shirt is simultaneously dried from the interior and the exterior thereof. A ring can then be removably secured to the inlet valve such that the user can hang the balloon therefrom to ensure an even flow of air across an entire exterior thereof to promote efficient drying of the shirt. When the shirt is fully dry, the shirt can be removed and stored, while the balloon can then be deflated and hung from the ring to minimize storage space occupied thereby.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inflatable shirt drying system, comprising:

a balloon having a torso and a pair of arms extending therefrom, such that the balloon is configured to emulate a human torso when in an inflated state;

an inlet valve disposed on the balloon, the inlet valve in fluid communication with an interior volume of the balloon a cap removably secured to the inlet valve, the cap comprising a curved member having a first end affixed to an upper side of the cap and a second end affixed to the upper side of the cap, the curved member defining a ring having an opening configured to receive a hook for hanging the balloon from a support structure;

a plurality of micro-perforations disposed across the balloon, the plurality of micro-perforations in fluid communication with the interior volume;

wherein the plurality of micro-perforations are configured to emit a stream of fluid from the interior volume when the interior volume exceeds a threshold pressure;

an air supply having an air inlet and an air outlet, the air outlet configured to removably secure to the inlet valve;

wherein the air supply includes a pump configured to inflate the balloon to a desired pressure.

2. The inflatable shirt drying system of claim 1, wherein the balloon further comprises a neck extending from an upper portion thereof, the neck configured to extend through an opening in a shirt.

3. The inflatable shirt drying system of claim 2, wherein the inlet valve is disposed on the neck.

4. The inflatable shirt drying system of claim 1, wherein the inlet valve comprises a one-way valve.

5. The inflatable shirt drying system of claim 1, wherein a base of the torso comprises a planar surface.

6. The inflatable shirt drying system of claim 1, wherein the air supply further comprises a heating element therein, the heating element configured to heat air passing through the air supply to a desired temperature.

7. The inflatable shirt drying system of claim 6, wherein the heating element comprises a heat control configured to adjust the temperature of the heating element.

8. The inflatable shirt drying system of claim 1, wherein the air supply further comprises a pressure sensor configured to detect the pressure within the interior volume.

9. The inflatable shirt drying system of claim 8, wherein the pump is configured to adjust the flowrate of air through the air supply to maintain a desired pressure within the interior volume as detected by the pressure sensor.

10. The inflatable shirt drying system of claim 1, wherein the air supply further comprises a pressure control thereon, the pressure control configured to adjust the flowrate through the air outlet to a desired flowrate.

11. The inflatable shirt drying system of claim 1, wherein the plurality of micro-perforations are disposed evenly across the balloon.

* * * * *